United States Patent [19]

Skylvik

[11] Patent Number: 4,485,920

[45] Date of Patent: Dec. 4, 1984

[54] RESEALABLE PACKAGE

[75] Inventor: Arnold R. Skylvik, Trollhättan, Sweden

[73] Assignee: Aktiebolaget Cerbo, Trollhattan, Sweden

[21] Appl. No.: 568,132

[22] Filed: Jan. 4, 1984

[30] Foreign Application Priority Data

Feb. 11, 1983 [SE] Sweden ..... 8300749

[51] Int. Cl.[3] ..... B65D 6/06; B65D 73/00

[52] U.S. Cl. ..... 206/468; 206/461; 206/467; 229/11

[58] Field of Search ..... 206/461, 465, 467, 468, 206/470, 471; 229/9, 11, 19, 20; 220/346, 351

[56] References Cited

U.S. PATENT DOCUMENTS

| | | | |
|---|---|---|---|
| 2,796,985 | 6/1957 | Gorton | 206/465 |
| 2,975,889 | 3/1961 | Brown | 206/470 |
| 3,157,280 | 11/1964 | Perdue et al. | 206/468 |
| 3,382,972 | 5/1968 | Phipps | 206/468 |
| 3,896,933 | 7/1975 | Bockemühl | 206/461 |
| 3,939,979 | 2/1976 | Nevmayer | 206/461 |

FOREIGN PATENT DOCUMENTS

| | | | |
|---|---|---|---|
| 2619824 | 11/1977 | Fed. Rep. of Germany | 206/461 |
| 1204801 | 1/1960 | France | 206/462 |
| 401356 | 4/1966 | Switzerland | 206/468 |

*Primary Examiner*—William T. Dixson, Jr.
*Assistant Examiner*—Brenda J. Ehrhardt
*Attorney, Agent, or Firm*—Christel, Bean & Linihan

[57] ABSTRACT

A resealable package comprising a backing and a bubble displaceably mounted on it and having an opening facing towards the backing. Said opening is at least partially uncoverable for removal of the goods enclosed by the package. The package includes a flap on the backing, said flap being foldable from a first position enclosing an object removal opening in the backing and preventing bubble displacement relative backing, to a second position uncovering the removal opening and enabling displacement of the bubble. In said second position at least parts of the openings of the bubble and backing coincide.

6 Claims, 3 Drawing Figures

RESEALABLE PACKAGE

The present invention relates to a resealable package comprising a backing and a bubble displaceably mounted on it, the bubble having an opening facing towards the backing, the opening being at least partially uncoverable for removal of the objects enclosed in the package.

The package is of the bubble type, with a cardboard backing and a bubble of clear plastics material for displaying the contents, the backing being provided with a hole for suspension and with printed information as to its contents.

Packages of the kind mentioned above are already known. The greatest disadvantage with them is that the backing and/or bubble are too complicated or incompletely formed to allow simple opening and secure reclosure of the package. Another disadvantage is that the known packages are not provided with serviceable means for indicating that they have not been opened by unauthorized persons before they come into the hands of the user.

One object of the invention is to alleviate the disadvantages with already known packages of the kind described in the introduction, and to provide a package relatively cheap to manufacture, allowing easy opening and closing with secure resealing of the bubble relative the backing, and which is provided with means indicating whether the package has been opened before its contents are to be used.

This object is attained by the inventive package being given the characterizing features disclosed in the claims.

Figure 1:
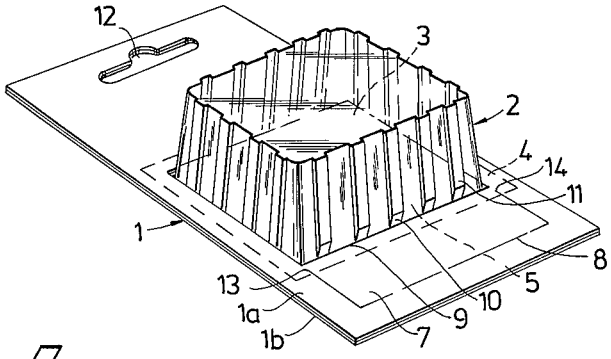
Figure 2:
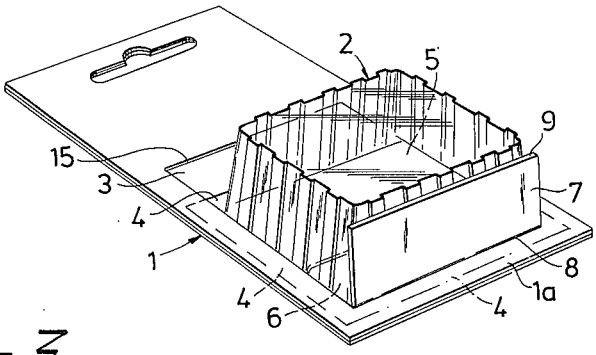
Figure 3:
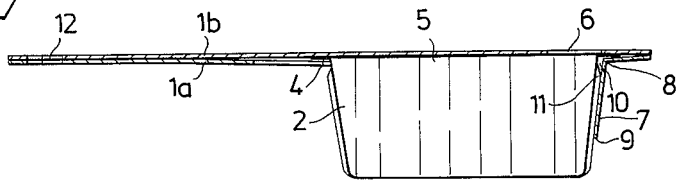

FIG. 1 is a perspective view of an unopened package in accordance with the invention, FIG. 2 is a perspective view of the package of FIG. 1, but in an opened condition, and FIG. 3 is a sectioned side view of the opened package of FIG. 2.

The package illustrated in the figures includes a flat sheet backing 1 and a transparent plastic bubble 2. The backing 1 consists of two cardboard portions 1*a* and 1*b*, which are separate or joined to each other along a folding line, and which are finally joined to each other after the bubble 2 has been taken through a large rectangular hole 3 in the backing portion 1*a* and its four identical flanges 4, which surround and project from a large quadratic opening 5 in the bubble, have come into engagement against the edges portion 1*a* with the bubble thus placed in its hole 3 is joined to the portion 1*b* in some suitable manner, while ensuring, however, that the flanges 4 may be displaced freely and unobstructedly between both portions.

The backing portions 1*a* and 1*b* are provided with a common hole 12 for suspending the package, and they also have two cutouts coinciding with each other and together forming a rectangular hole 6 through the backing. A flap 7, integral with the portion 1*a*, is foldable along a line 8 between a first position illustrated in FIG. 1, in which it covers the hole 6 and the flange 4 most closely adjacent the hole, and a second position illustrated in FIGS. 2 and 3, in which it is folded away from portion 1*a*. In the first position of flap 7, its free edge 9, parallel to the line 8, engages in grooves 10 in one side wall of the bubble, and is locked there with the aid of the yielding portions 11 situated above the grooves 10 of this side wall. Displacement of the bubble in relation to the backing 1 is prevented in this position. In the second position of the flap 7, the bubble may be displaced in a direction towards the hole 6, such that a part of the bubble opening 5 coincides with the hole 6. Displacement can continue until the aforementioned side wall of the bubble 2 comes into engagement against the part of flap 7 attached to the backing portion 1*a* along the line 8. After terminated displacement, a part of the contents of the package, e.g. dragées, may be shaken out of the removal opening formed by the opening 5 and hole 6.

When the package is fabricated, the edges of the flap 7 at right-angles to the line 8 are joined to the backing portion 1*a* along weakening lines 13, 14, which are raptured when the contents of the package are to be taken out. How to open and close the package will now be summarily described.

To open the package, the flap 7 is pressed in from the rear side of the backing 1 in FIG. 1 in a direction from the hole 6 to the position illustrated in FIG. 2. The joint, serving as a guarantee seal, between the flap and backing portion 1*a* is broken along the lines 13 and 14. The bubble is subsequently displaced towards the flap 7, both the opposing flanges 4 parallel to the lines 13 and 14 being guided between backing portions 1*a* and 1*b* until the grooves 10 or parts 11 come into engagement against the edges conforming with the line 8, along which the flap has been folded. The package is suitably held such that the bubble opening 5 is upwardly directed during displacement thereof, after which the package is turned so that a portion of its contents may be fed out from the hole 6, possibly after shaking the package somewhat.

When the package is to be closed, the bubble 2 is displaced in a direction away from the flap 7, by the bubble being directly actuated with the fingers until the flange 4, parallel to, and farthest away from the flap, is inserted between the portions 1*a* and 1*b*, and the side wall of the bubble provided with this flange has come into engagement against an edge 15 of the opening 3 formed in the backing portion 1*a*. Displacement of the bubble may be performed instead by the flap 7 being pressed against the side wall of the bubble. With the latter in the position illustrated in FIG. 1, the flap 7 is pressed towards the hole 6, until its free edge 9 snaps into the grooves 10 via the yielding parts 11. In this position the bubble is locked relative the backing 1 and cannot be displaced in any direction relative to the backing.

Although only one embodiment of the invention has been illustrated on the drawings and described above, it should be understood that the invention is not limited to this embodiment, and is only restricted by the disclosures in the claims.

I claim:

1. Resealable package comprising a backing with an object removal opening; a bubble displaceably mounted on the backing and having an opening facing towards the backing, this opening at least partially being uncoverable for removal of the goods enclosed in the package;

a flap on the backing;

said flap being foldable from a first position enclosing the object removal opening in the backing and preventing displacement of the bubble relative the backing, to a second position uncovering the removal opening and enabling displacement of the bubble relative the backing; and at least parts of the openings of the bubble and backing coincide.

2. Package as claimed in claim 1, wherein the flap is foldable along a line at right angles to the displacement direction of the bubble and suitably forming one defining edge of the opening in the backing, and wherein the free edge facing away from this line in the first position of the flap is locked in a locking means formed on the bubble.

3. Package as claimed in claim 2, characterized in that the locking means comprises at least one groove, parallel to the free flap edge, and parts of the bubble, contiguous to said groove, said parts being yielding suppressable by said flap edge while enabling its engagement with, and removal from the groove.

4. Package as claimed in claim 1, wherein the backing comprises two mutually connected and mutually overlapping sheets defining grooves between themselves, the bubble opening at least partially surrounding said grooves in which flanges projecting from the edges of the bubble are displaceably disposed, wherein one sheet continuously encloses at least a portion of the bubble opening, in that said backing opening is formed by cutouts in both sheets and wherein the flap is a part of at least one sheet.

5. Package as claimed in claim 1, wherein the folding line of the flap forms a stop preventing displacement of the bubble past the flap when the latter assumes its second position.

6. Package as claimed in claim 1, wherein the flap is a part of the backing and is connected to it along a folding line and is also preferably at right angles to weakening lines in the backing material at right angles to said folding line, said backing material being disposed for rupturing along said weakening line when the flap is folded from its first position for the first time.

* * * * *